United States Patent [19]

Cooke

[11] 4,139,112

[45] Feb. 13, 1979

[54] SAFETY CLOSURE CAP

[76] Inventor: Carl W. Cooke, 233 Wilshire Blvd., Santa Monica, Calif. 90401

[21] Appl. No.: 846,767

[22] Filed: Oct. 31, 1977

[51] Int. Cl.[2] ..... B65D 85/56

[52] U.S. Cl. ..... 215/217; 215/222

[58] Field of Search ..... 215/217, 218, 222

[56] References Cited

U.S. PATENT DOCUMENTS

| | | | |
|---|---|---|---|
| 2,776,066 | 1/1957 | Thornton | 215/217 |
| 4,032,028 | 6/1977 | Reiss | 215/217 |

*Primary Examiner*—George T. Hall

*Attorney, Agent, or Firm*—John E. Vanderburgh

[57] ABSTRACT

A single piece threaded safety closure for sealing the open end of a container. At least three enlarged members are equi-angularly spaced about the closure thread and form locking shoulders adapted to inter-engage corresponding shoulders defined on the thread of the container to lock the threads together and prevent removal of the closure except by special manipulation. A resilient liner is compressed when the closure is drawn down on the container and the compressed resilient liner urges the cap upwadly and maintains the shoulders in locked engagement.

5 Claims, 5 Drawing Figures

SAFETY CLOSURE CAP

BACKGROUND OF THE INVENTION

This invention relates to closures for containers, and more particularly to "safety" closures having a locking feature so that when sealingly engaged on a container, the cap is locked thereon and can be removed only by special manipulation.

Safety closures are designed to lock onto a container in such a fashion as to make their removal difficult, particularly for children. Safety closures are typically used in connection with containers for drugs, medicines, corrosive materials and the like which can cause serious injury. For example, it is required that certain pharmaceuticals be dispensed in containers provided with safety closures in order to avoid accidental opening.

Several designs of safety closures are available including single piece and multi-piece designs. The single piece closure comprises a single closure having a thread design typically consisting of a plurality of separate projections or lugs which are adapted to engage with or between corresponding indentations or lugs on a container so that the closure is locked into position thereon. The closures are removed by manipulating the cap to disengage the lugs and free the closure. An example of the multi-piece design are closures designed with conventional threading and which are provided with an outer member, such as for example, a freely rotatable outer ring member, so that the closure can be removed only by exerting a substantial force to frictionally engage the ring and the closure in order to permit rotation of the closure portion. The single piece closures having a locking thread design are preferred as they are easier to manufacture and are difficult to remove without special manipulation.

Examples of the various designs for safety closures are to be found in U.S. Pat. No. 3,072,276 (Nickols), No. 3,360,147 (Shaeffer) and No. 2,776,066 (Thornton). A significant problem encountered with prior art safety closures is that when employing a multiplicity of projections, or lugs, as the locking means it has been found that they can often be easily sheared, thus neutralizing or substantially reducing the effectiveness of the safety locking feature. Also, in some prior art designs, it is necessary that lug or projection and the closure be formed from a resilient material so as to provide the necessary flexibility to permit the closure to be urged into and out of its locked position. Such designs are unsuitable for use with metal, glass, rigid plastic, or the like, which materials are often preferred for use as closure compositions.

Cooke, in U.S. Pat. No. 3,888,376 and U.S. Pat. No. 3,942,899 discloses an improved closure design employing a substantially continuous thread in which the locking means are integrally formed as part of the thread. In this manner the shear strength of the locking means is increased and the probability of removing the closure without the proper manipulative steps by shearing the locking means is substantially reduced. Typically, however, only one or possibly two locking means are integrally formed on the threads and it has been found that while being urged into the locking position, uneven pressure is exerted between the closure and the container end which results in uneven compression on the resilient member and loss of reliability of its sealing function.

SUMMARY OF THE INVENTION

The present invention is an improved single piece safety closure of the type disclosed in Cooke U.S. Pat. No. 3,952,899 in which compressive force of the resilient member is maintained substantially uniform while drawing the cap into sealing engagement thereby improving the reliability of the sealing function of the closure.

In accordance with the invention, at least three corresponding locking means are provided on the container thread and the closure thread and these locking means are equiangularly spaced about the circumference of a circle defined by the closure thread and the corresponding container thread. In this manner the closure is provided with a stable support base while it is drawn down on the container and the compressive forces exerted on the resilient member are substantially evenly distributed thereabout for uniform sealing of the container when the closure is in the fully sealed and locked position.

In one embodiment, the locking means consists of at least three projecting members integrally formed on and equiangularly spaced about the thread of the closure and each member defines a shoulder on the closure thread. Three equiangularly spaced corresponding indentations or cut-out portions are provided on the container thread and these define corresponding shoulders for locking engagement with the shoulder defined on the container thread when the closure is drawn in sealing position on the container. In another embodiment, the upper surface of the closure thread is cut away at three equiangularly spaced points for receiving a shoulder defined on the container thread by corresponding equiangularly spaced projecting members.

In all embodiments of the invention, the corresponding locking means are disposed on their respective threads for locking when the closure is fully drawn down on the container.

Other aspects and advantages of the invention will become apparent from the following detailed description, taken in conjunction with the accompanying drawings.

DESCRIPTION OF THE INVENTION

Figure 1:
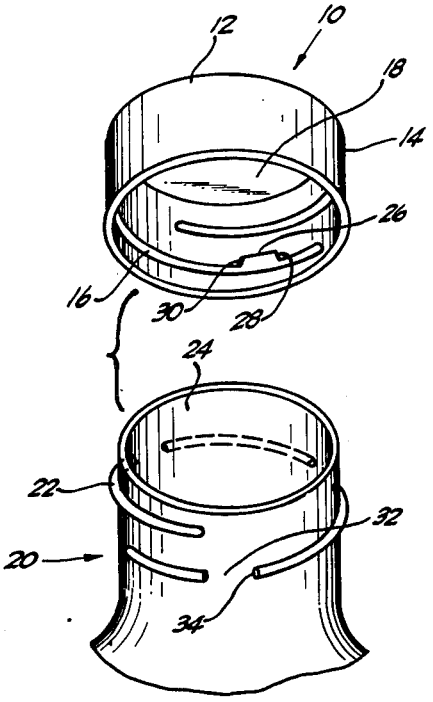
FIG. 1 is an isometric view of a closure showing a portion of the interior thereof and the neck portion of a container illustrating the locking means integrally formed as part of the closure thread in accordance with the present invention.

Referring to FIG. 1, a safety closure of the type to which the present invention relates is shown generally as 10 and includes a top portion 12, a depending skirt portion 14. A continuous helical thread 16 is formed on the inner wall of the depending skirt portion. A resilient sealing member 18 lines the interior face of the top portion 12. A container, shown generally as 20, is provided with a substantially continuous helical thread 22 about the neck portion of the container adjacent an open end 24.

Figure 2:
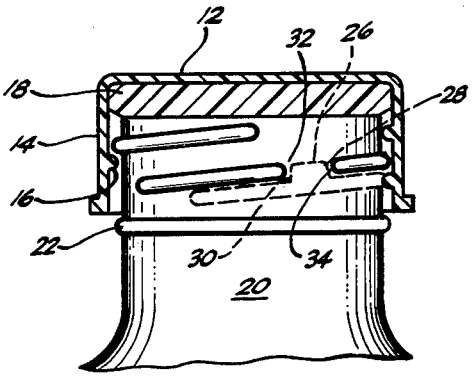
FIG. 2 is a side view, partially in section, showing the closure of FIG. 1 drawn into sealing engagement and locked on the container.

The locking and sealing features are more clearly illustrated in FIG. 2 where the open end 24 and neck portion of the container 20 are received within the depending skirt portion 14 of the closure 10 and the closure thread 16 and container thread 22 are engaged to draw the closure 10 downward on the container so as to compress the sealing member 18 between the open end of the container and the top portion 12 of the closure. By virtue of this compressive action, the sealing member 18 surrounds and seals the open end 24 of the closure 20.

Individual locking means consist of a projecting member 26 integrally formed on the closure thread 16 and having a camming surface 28 and a shoulder 30 extending generally perpendicularly to the axis of the closure thread on the side opposite the camming surface. The container thread is provided with a corresponding cut-away portion 32 defining a shoulder 34 extending generally perpendicularly to the container thread. The cut-away portion 32 is sufficiently large to receive at least a portion of the projecting member 26. The locking action is achieved by the inter-engagement of the shoulder 30 and the shoulder 34 when the projecting member 26 is received in the cut-out portion 32 of the container thread 22 as the closure 10 is drawn into sealing relation on the container 20.

Figure 3:
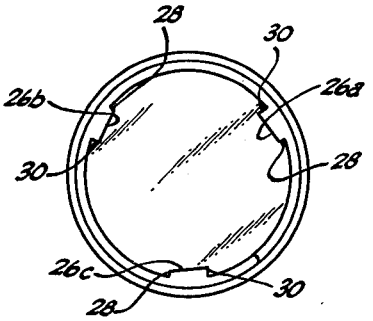
FIG. 3 is a bottom plan view of closure of FIG. 1.
Figure 4:
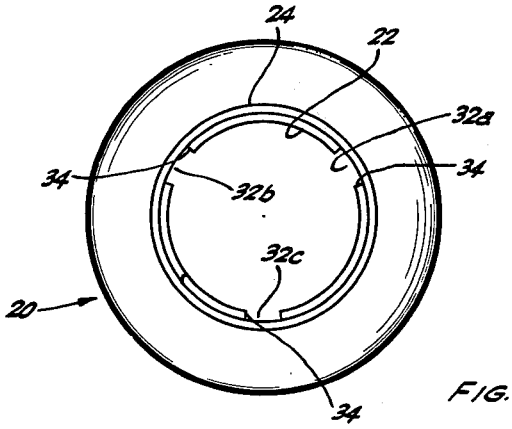
FIG. 4 is a top plan view of the container of FIG. 1.

As most clearly shown in FIGS. 3 and 4, at least three projecting members **26*a*, 26*b* and 26*c* are provided on the closure thread 16 in accordance with the invention. The members 26*a*, 26*b* and 26*c* are equiangularly spaced about the circumference of the circle defined by the thread 16, which is to say that the arc between any pair of the projecting members is equal to the arc between any other pair of the members. Three corresponding cut-out portions 32*a*, 32*b* and 32*c* are provided on the thread 22 of the container 20 and are equiangularly spaced to correspond with the projecting members 26*a*, 26*b* and 26*c* respectively, when the closure 10 is drawn down on the container 20**.

In operation, the open end 24 of the container 20 is received within the depending skirt portion 14 of the closure and the start end of the closure thread 16 is disposed beneath the start end of the container thread 22 for drawing the closure down over the open end of the container responsive to a clockwise rotation of the cap. As the cap is rotated, the camming surface 28 of the projecting member **26*a* engages the start end of the container thread 16 forcing the closure thread 16 downwardly away from the container thread and initiating compression of the resilient member 18. The closure 10 is then drawn down onto the container 20 by the container thread 22 acting against the upper surface of the projecting members 26*a*, 26*b* and 26*c* until the closure is fully drawn down and the projecting members 26*a*, 26*b* and 26*c* are aligned with their respective cut-out portions 32*a*, 32*b* and 32*c* on the container thread 22. The resilient liner 18, being highly compressed at this point, urges the closure 12 to move upwardly on the neck of the container 20 thus causing the projecting members 26*a*, 26*b* and 26*c* to move into the respective cut-out portions 32*a*, 32*b* and 32*c* of the container thread 22. The shoulders 30 of each of the members 26*a*, 26*b* and 26*c* act against the shoulders 34 of the closure thread 22 to lock the closure 10 on the container 20** by preventing counter rotation of the closure.

The closure 10 is removed by exerting sufficient downward force to oversome the urging of the compressed resilient member 18, causing the cap to move downwardly on the neck of the comtainer 20. The projecting members **26*a*, 26*b* and 26*c* are moved out of the corresponding cut-out portions 32*a*, 32*b* and 32*c*** respectively permitting the rotation of the cap in the opposite direction so that it can be removed.

By supporting the closure 10 at at least three equiangular points about the circumference defined by the closure thread 16, the closure is provided with a stable support base and thus is not tilted with respect to the axis of the container. Accordingly, the compressive force exerted on the resilient member 18 is substantially evenly distributed so that sealing pressure between the open end 24 of the container and the resilient member 18 is substantially uniform. It will be apparent that when the supporting points are not equiangularly spaced, the closure can be tilted while being drawn down on the container 20 and compressive force on the resilient member 18 will be uneven. This can result in uneven sealing about the periphery of the open end 24 of the container 20 and can result in leakage of the container contents.

Figure 5:
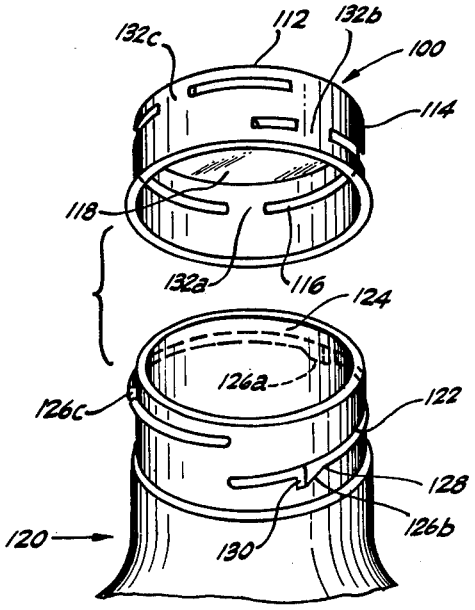
FIG. 5 is an isometric view of a closure and neck portion of a container illustrating another embodiment of the invention.

While the invention has thus far been described as having the enlarged members formed on the thread of the closure, it will be apparent that the relative location of the projecting members and cut-away portions can be reversed. As more clearly shown in FIG. 5, a closure, shown generally as 100, has a top portion 112, a depending skirt portion 114 and a substantially continuous helical thread 116 is formed on the inner face of the depending skirt portion. A resilient sealing member 118 lines the interior face of the top portion 112. A container, shown generally as 120, is provided with a continuous helical thread 122 about the neck portion adjacent an open end 124.

Three equiangularly spaced projecting members **126*a*, 126*b* and 126*c* are integrally formed on the container thread. Each of the projecting members define a camming surface 128 on one side, and a shoulder 130 on the opposite side. The closure thread is interrupted to define equiangularly spaced cut-away portions 132*a*, 132*b* and 132*c* which are positioned on the closure thread for correspondence with the projecting members 126*a*, 126*b* and 126*c* respectively when the closure is drawn down on the container 120 for sealing the open end 124. The locking of the closure is substantially as described except that responsive to the resilient member 118, the cut-away portions 132*a*, 132*b* and 132*c* are drawn toward and receive the corresponding members 126*a*, 126*b* and 126*c* of the container thread 122. Removal of the closure 100 is as described in connection with the embodiment of the invention illustrated in FIGS. 1–4. The closure is provided with a stable base as in the embodiment of the invention shown in FIGS. 1–4 and pressure is substantially uniformly distributed about the resilient liner 118** as has already been described.

While the invention has been described in connection with the use of three equiangularly spaced locking means, it is within the scope of the invention to utilize a greater number, for example, four or even six equiangularly spaced locking means. It is essential to the invention, however, that at least three closure support points be provided so that the closure be stably and uniformly supported while being drawn down onto the container so that compressive forces exerted on the resilient members are are substantially evenly distributed.

Various embodiments and modifications of the invention have been described in the foregoing description and illustrated in in the drawings. Various modifications of the invention will be apparent to those skilled in the art. Such modifications are included within the scope of the invention as defined by the appended claims.

What is claimed is:

1. A safety closure for sealing the open end of a threaded container, said safety closure comprising:

a single unit comprising a top portion defining an interior face, a resilient sealing member lining the interior face of said top portion and a depending cylindrical skirt portion;

a substantially continuous helical thread disposed on the inner wall of said depending skirt portion for cooperation with said container thread responsive to the rotation of said closure with respect to said container to draw said top portion of said closure against the open end of said container compressing said resilient liner therebetween and sealing the open end of said container;

at least three locking means being equiangularly spaced about said closure thread for engagement with corresponding locking members on said container thread to prevent reverse rotation of said closure after it has been drawn into sealing relation on the container.

2. The closure of claim 1 wherein each of said locking means comprise a projecting member integrally formed on said closure thread, said member defining a shoulder extending generally perpendicular to the closure thread.

3. The closure of claim 1 wherein each of said locking means comprise a shoulder extending generally perpendicularly to the closure thread, said shoulder being defined by a cut-away portion of said closure thread.

4. In the combination of a container including a cylindrical neck having an open end, a closure for said container having a top overlying said open end and a depending cylindrical skirt surrounding a portion of the neck of said container adjacent said open end, a resilient sealing member lining the interior face of said top for sealing the open end of said container, continuous thread means carried on the neck portion of said container adjacent the open end and continuous thread means carried on the inner wall of the skirt portion of said closure, the thread means of said container and said closure cooperating to axially draw said closure into sealing position on said container with said resilient sealing member compressed between the open end of said container and the top of said closure when said closure is rotated respective to said container, the improvement comprising:

at least three projecting members on said closure thread and corresponding cut-out portions on said container thread for receiving said projecting members, said projecting members being equiangularly spaced about a circumference defined by said closure thread and said cut-out portions being equiangularly disposed about a circumference defined by said container thread, said projecting members and corresponding cut-out portions disposed on said closure thread and said container thread respectively for substantial alignment with each other when said closure is in the sealing position on said container and for locking said closure on said container when said projecting members are received in said corresponding cut-out portion responsive to the urging of said closure axially from the open end of said container by said compressed resilient member.

5. In the combination of a container including a cylindrical neck having an open end, a closure for said container having a top overlying said open end and a depending cylindrical skirt surrounding a portion of the neck of said container adjacent said open end, a resilient sealing member lining the interior face of said top for sealing the open end of said container, continuous thread means carried on the neck portion of said container adjacent the open end and continuous thread means carried on the inner wall of the skirt portion of said closure, the thread means of said container and said closure cooperating to axially draw said closure into sealing position on said container with said resilient sealing member compressed between the open end of said container and the top of said closure when said closure is rotated respective to said container, the improvement comprising:

at least three projecting members on said container thread and corresponding cut-away portions on said closure thread for receiving said projecting members, said projecting members being equiangularly spaced about a circumference defined by said container thread and said cut-away portions being eqiangularly disposed about a circumference defined by said closure thread, said projecting members and corresponding cut-away portions disposed on said container thread and said closure thread respectively for substantial alignment with each other when said closure is in the sealing position on said container and for locking said closure on said container when said projecting members are received in said corresponding cut-out portion responsive to the urging of said closure axially from the open end of said container by said compressed resilient member.

* * * * *